US011162686B2

(12) United States Patent
Gonzalez Palacio et al.

(10) Patent No.: US 11,162,686 B2
(45) Date of Patent: Nov. 2, 2021

(54) SYSTEM FOR TURNING OFF STOVE KNOBS, AND COOKTOPS COMPRISING SAME

(71) Applicant: UNIVERSIDAD DE MEDELLIN, Medellin (CO)

(72) Inventors: Mauricio Gonzalez Palacio, Medellin (CO); Mario Alberto Luna Del Risco, Medellin (CO); Julian Esteban Tabares Montoya, Medellin (CO)

(73) Assignee: UNIVERSIDAD DE MEDELLIN, Medellin (CO)

( * ) Notice: Subject to any disclaimer, the term of this patent is extended or adjusted under 35 U.S.C. 154(b) by 201 days.

(21) Appl. No.: 16/462,950

(22) PCT Filed: May 15, 2018

(86) PCT No.: PCT/IB2018/053397
§ 371 (c)(1),
(2) Date: May 22, 2019

(87) PCT Pub. No.: WO2018/224899
PCT Pub. Date: Dec. 13, 2018

(65) Prior Publication Data

US 2019/0277508 A1 Sep. 12, 2019

(30) Foreign Application Priority Data

Jun. 5, 2017 (CO) ..... NC2017/0005567

(51) Int. Cl.
*F24C 3/12* (2006.01)
*F23N 5/10* (2006.01)
(Continued)

(52) U.S. Cl.
CPC ..... *F24C 3/126* (2013.01); *F23N 1/00* (2013.01); *F23N 5/105* (2013.01); *F23N 5/206* (2013.01); *F23N 5/245* (2013.01); *F23N 2241/08* (2020.01)

(58) Field of Classification Search
CPC . F24C 3/126; F23N 1/00; F23N 5/105; F23N 5/206; F23N 5/245; F23N 2241/08; F23N 5/203; F23N 1/005
See application file for complete search history.

(56) References Cited

U.S. PATENT DOCUMENTS 3,660,006 A * 5/1972 Crosta ..... F23D 11/04 431/168
2007/0204858 A1* 9/2007 Abelbeck ..... F24C 3/12 126/41 R (Continued)

*Primary Examiner* — Jorge A Pereiro
(74) *Attorney, Agent, or Firm* — Hoglund & Pamias, PSC; Roberto J. Rios

(57) ABSTRACT

The present invention relates to an electromechanical system for automating the turning off of the knobs of a stove. The system can quickly identify the occurrence of a gas leak and turn off the knob corresponding to the burner that is leaking. The system is also connected to a user interface, providing real-time information about the status of the burners and allowing the user to turn off the knobs remotely. The system has an improved service life, does not considerably change the aesthetics of the stove and can be designed to fulfil different torque requirements. The invention also relates to cooktops comprising said system.

15 Claims, 3 Drawing Sheets

(51) Int. Cl.

| | |
|---|---|
| ***F23N 5/20*** | (2006.01) |
| ***F23N 5/24*** | (2006.01) |
| ***F23N 1/00*** | (2006.01) |

(56) References Cited

U.S. PATENT DOCUMENTS

| | | | | |
|---|---|---|---|---|
| 2015/0351579 | A1* | 12/2015 | Johncock | A47J 27/10<br>426/231 |
| 2017/0003024 | A1* | 1/2017 | Vendramini | F23N 5/24 |
| 2017/0067648 | A1* | 3/2017 | Norman | H05B 1/0266 |
| 2018/0003392 | A1* | 1/2018 | Babu | F24C 7/082 |
| 2018/0010805 | A1* | 1/2018 | Bach | F24C 7/087 |

* cited by examiner

SYSTEM FOR TURNING OFF STOVE KNOBS, AND COOKTOPS COMPRISING SAME

FIELD OF THE INVENTION

The present invention is related to systems for the detection of automated turning on and off of stove knobs.

PRIOR ART

Document CN205102186 discloses a high efficiency stove, which can be monitored and controlled by wireless communication. The system is composed of a microprocessor, a solenoid valve (which is installed to enable and disable gas supply to the entire stove), an electronic ignition system, flame detectors, temperature sensors, leak detectors, alarm and flame protection system. The leak detector generates an alert when there is already a high concentration of natural gas in the environment. Moreover, this technology uses a solenoid valve.

Patent CN105333464 refers to a stove that implements the concept of "Internet of Things", which has a solenoid valve and an intelligent control center that contains: a main module, a gas consumption calculation module, a timing module to control the ignition, a leak detector module and a wireless communication module to control the system. The stove uses a solenoid valve to control the gas supply to the entire stove, which is installed invasively inside the circuit. The gas leak is detected by a gas in the air detector, once a high concentration of natural gas is reached within a confined atmosphere.

Document CN101706113 discloses an intelligent gas cooker comprising a communication module with the user through a telephone. The technology uses the determination of gas concentration change in the air to detect leaks. To detect the leak and generate an alert, this technology requires that the concentration of gas in the air be high.

Patent CN105258170 discloses a stove and method for controlling the same, comprising food temperature sensors, a control terminal, motor knobs and an ignition heater. This stove and the method provide cooking instructions to the system to control combustion. This technology carries out food temperature control.

SUMMARY OF THE INVENTION

The inventors of the present application have realized that there is a need in this technical field to develop a system for automating turning off the stove knobs, which allows fast identification of a gas leak in each knob of a stove, turning off each stove knob independently, that has an improved service life, that can be installed from factory, that has a greater torque for rotating the stem of the knobs and that simultaneously is in wireless communication with a user interface.

The inventors provide a system for automating turning off the stove knobs, capable of identifying gas leaks by measuring the change in temperature over time and sending an alert to the user when this happens by means of the "Internet of Things". Additionally, the system provided by the inventors is installed under the covers of the stoves, which increases their useful service life and avoids modifying the knobs designed for said appliances, preserving the aspect ratio and the aesthetics thereof. By being installed in the inner lower part of the covers, the system can be configured to generate a greater torque for the rotation of the knobs, considering possible tolerances in the manufacture of the stems of the gas supply valves of the covers.

Likewise, the inventors provide stove covers that comprise these systems.

DETAILED DESCRIPTION OF THE INVENTION

The present invention is directed to an electromechanical system for stoves, to automate turning off its knobs in case of leakage and to the kitchen covers that comprise them.

The system comprises an electromechanical system, temperature measurement instruments, switches to capture the opening of the gas valves of each burner and a master embedded electronic device.

Figure 1:
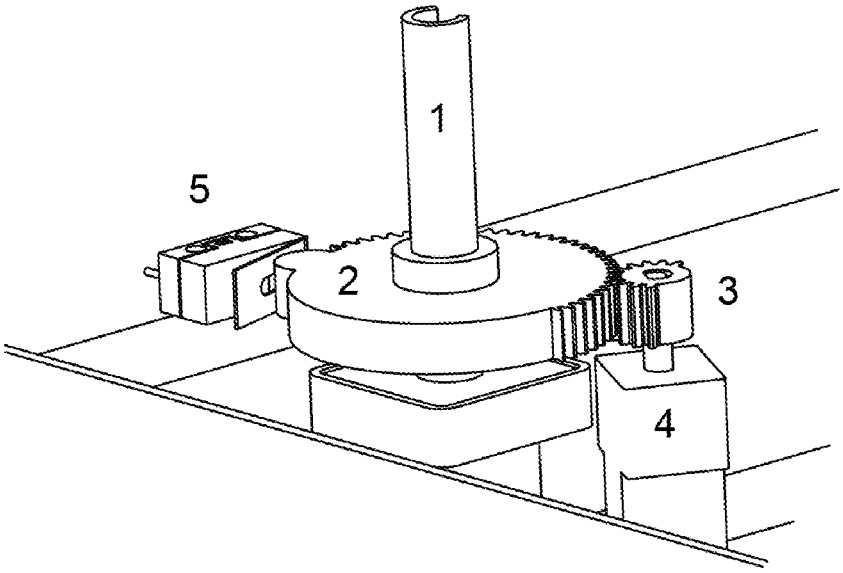
FIG. 1 shows a perspective view of the different elements of the electromechanical system, for a knob. The system can be installed on as many shafts of knobs as burners provided in the cover.

In one embodiment of the invention, the electromechanical system is assembled in the inner lower part of an oven and may comprise a pinion coupled to a shaft of a knob of a burner (2), a motor (4), a pinion coupled to the motor (3) and a micro switch (5). The system is coupled to a knob shaft (1), as can be seen in FIG. 1. In this embodiment, it is possible to provide the electromechanical system on as many knob axes as required by the cover.

The pinion coupled to the knob shaft (2) comprises a notch near the micro switch (5), by means of which the micro switch (5) detects if the gas supply valve to the burner is opened. The pinion coupled to the knob shaft (2) is coupled to the pinion coupled to the motor (3), receiving torque to close the knob, coming from the motor (4).

Preferably, the pinion coupled to the motor (3) has teeth in only a portion of its perimeter, while in the rest it is circumferential. In this way, the pinion coupled to the motor (3) is coupled to the pinion coupled to the knob shaft (2) only when automated turning off is required. In this way, when the knob shaft (1) is manually operated by the user, there is no wear on the pinion coupled to the knob shaft (2), on the pinion coupled to the motor (3) and on the motor (4). The dimensions of the pinion coupled to the knob shaft (2) will depend on the torque required for a particular design.

Particularly, the pinion coupled to the motor (3) can have teeth in 30% of its perimeter, while in the remaining 70% it is circumferential.

The pinion coupled to the motor (3) is in contact with the motor (4) and with the pinion coupled to the shaft (2) of the knob, transmitting torque between the motor (4) and the pinion coupled to the shaft (2) of the knob. The pinion coupled to the motor (3) has teeth only in a portion of its perimeter, allowing coupling to the pinion coupled to the shaft (2) of the knob only when automated turning off is required; and in manual operations by the user there is no wear of the mechanical parts due to the disengagement of the pinion coupled to the shaft (2) of the knob with the pinion coupled to the motor (3) and to the motor (4).

The motor (4) transmits rotational movement to the pinion coupled to the motor (3), which in turn transmits rotational movement to the pinion coupled to the knob shaft (2), which transmits rotational movement to the knob shaft (1), thus turning off the burner.

The microswitch (5) determines the current state (open or closed) of the burner, when in contact with the notch of the knob shaft (2) and is in connection with the master device with a dry contact digital signal.

The temperature measuring instruments can be thermocouples and are connected to the master device. These instruments are arranged in the burners of the stove, in such a way that they measure the temperature of the flame in each one.

Figure 4:
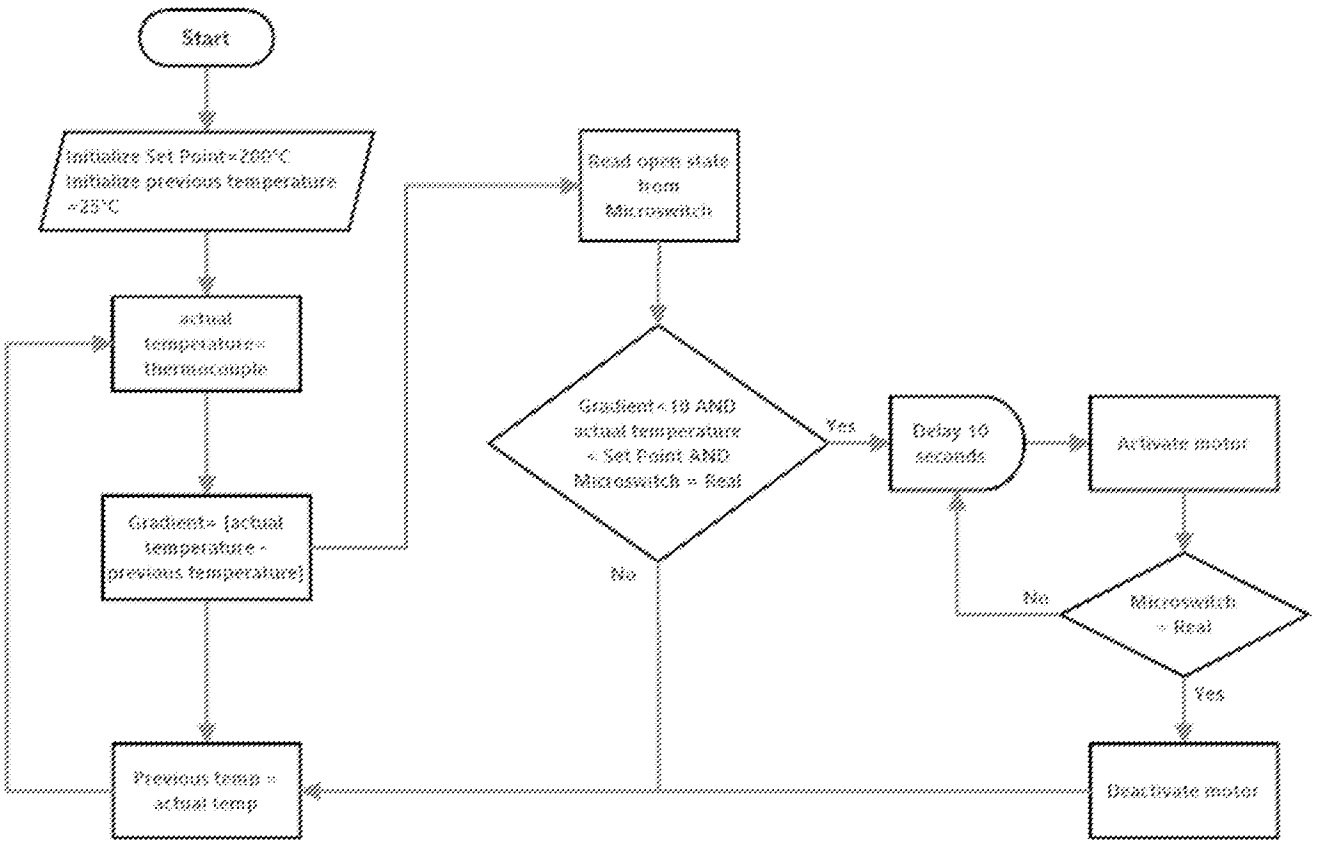
FIG. 4 shows a diagram of the control algorithm used by the system.

The master device comprises a processor that operates the closing control logic in the event of a leak, based on the temperature measurement made by the temperature measurement instruments in the burners, and on the open state determined by the micro switch. The master device is connected to the motor (4), to which it can send activation instructions, depending on the control logic (FIG. 4).

The processor of the master device is configured to execute the following steps:

i) set the value of room temperature as "previous temperature";

ii) measure the temperature in each of the burners using the temperature measurement instruments and assign it as "current temperature";

iii) calculate the difference in absolute value between the "current temperature" and the "previous temperature";

iv) read the opening state of the burners from the micro switch;

v) assign the value of "current temperature" to "previous temperature" and repeat steps ii) to iv) until the difference between the "current temperature" and the "previous temperature" is less than a defined value and the "current temperature" is less than a temperature setpoint and the open state is open;

vi) timing a delay time;

vii) activate the motor;

viii) read the opening state of the burners from the micro switch until the opening state is closed;

ix) deactivate the motor;

x) assign the value of "current temperature" to "previous temperature" and repeat steps ii) to ix).

In one embodiment of the invention, the ambient temperature value employed in step i) can be between −10° C. to 45° C.

Preferably, the comparison value of the difference between the current temperature and the previous temperature can be between 10° C. and 20° C.

The temperature setpoint can be between 150° C. to 250° C.

In particular, the delay time of step vi) can be 10 seconds.

By the above method, it is determined that a leak exists when the temperature of the cookers does not change considerably when the knobs are turned on, and the temperature has not exceeded the setpoint value. This way of determining the leak is much faster than if you compare the current temperature only with a reference temperature setpoint that indicates the leak. This, when a leak exists, cannot be identified until the temperature drops to that reference value; which does not happen with the control method employed by the system of the present invention.

The master device can be in wireless communication with a user interface and/or with a database server in the cloud.

When a leak is identified, the user can be further notified by means of an alert to the mobile interface or the leak event can be saved in the database server.

Optionally, the user can know if each knob is turned on or turned off and the existence of leaks through the mobile interface. From this interface, the user can control turning off the knobs remotely with immediate or timed instructions.

The present invention is also directed to the stove cover comprising the system described above (FIGS. 2 and 3).

Figure 2:
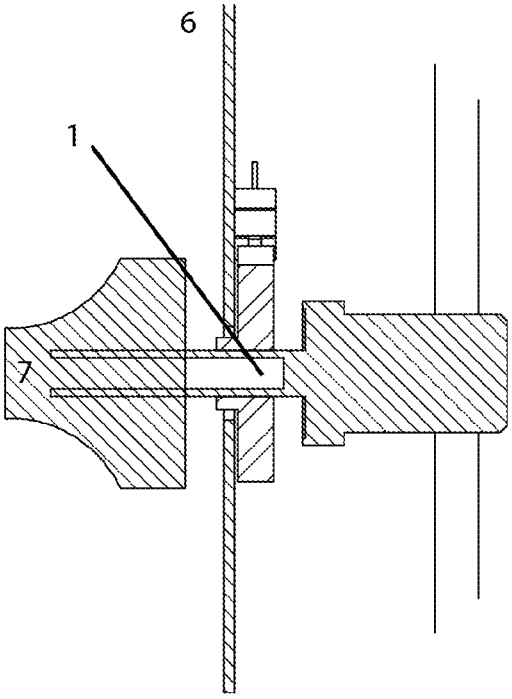
FIG. 2 shows the system of the invention, installed under the cover of the stove.
Figure 3:
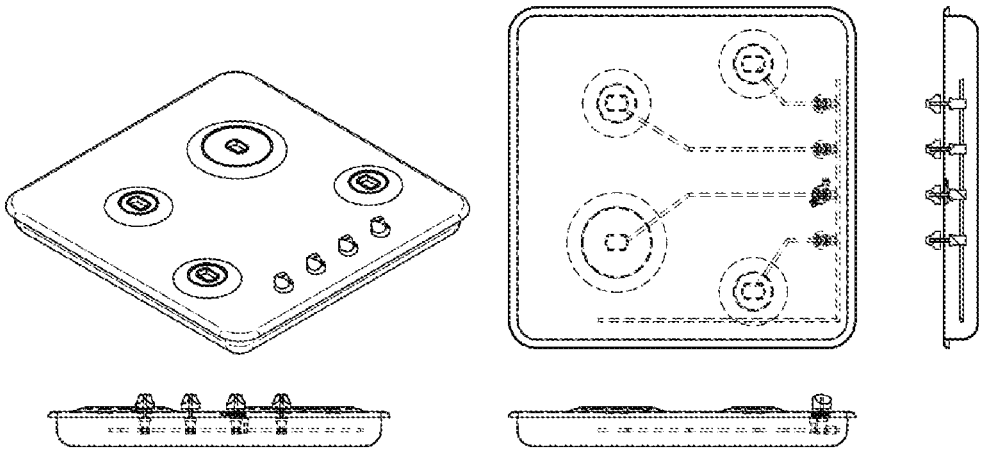
FIG. 3 shows a stove that has the system of the invention, installed under each of its knobs.

The stove cover comprises one or more stoves (also identified as burners) and one or more knobs (7) corresponding to each of these burners, which comprise an axis (1). The system described above is completely installed under the cover (6) of the stove. As can be seen in FIG. 2, the entire system is hidden under the cover and can use any knob designed by the manufacturer. In this way, the aesthetic design of the stove is not altered in any way. Also, since it is hidden under the cover, the wear of the elements due to humidity and temperature conditions is reduced, which increases the service life of the system. As the pinion coupled to the knob shaft (2) is hidden, it is possible to increase or decrease its diameter to generate a greater torque on the shaft (1) of the knob (7), without the need to alter the size of the knob, per se.

We claim:

1. A system for turning off stove knobs comprising:

a pinion (2) coupled to a knob shaft;

a motor (4);

a pinion (3) coupled to motor (4);

a micro switch (5);

temperature measuring instruments for burners of a stove; and a master device in communication with a user interface, wherein a notch of the pinion (2) coupled to the knob shaft is in contact with the micro switch (5) and is coupled with the pinion (3) coupled to the motor, which is in contact with the motor (4), so that the motor transmits rotational movement to the pinion (3) coupled to the motor and to the pinion (2) coupled to the knob shaft, generating movement of a knob axis (1), the micro switch (5) and the temperature measuring instruments connected to a processor of the master device, and the processor being configured to:

i) set a value of room temperature as "previous temperature";

ii) measure a temperature in each of the burners using the temperature measurement instruments and assign it as "current temperature";

iii) calculate a difference in absolute value between the "current temperature" and the "previous temperature";

iv) read an opening state of the burners from the micro switch, wherein said opening state is set to either open or closed based on the contact between said notch on the pinion (2) coupled to the knob shaft and said micro switch (5);

v) assign the value of "current temperature" to "previous temperature" and repeat steps ii) to iv) until the calculated difference between the "current temperature" and the "previous temperature" is less than a defined value and the "current temperature" is less than a temperature setpoint and the opening state is open;

vi) timing a delay time;

vii) activate the motor;

viii) read the opening state of the burners from the micro switch until the opening state is closed;

ix) deactivate the motor;

x) assign the value of "current temperature" to "previous temperature" and repeat steps ii) to ix).

2. The system according to claim 1, wherein the temperature sensor is a thermocouple.

3. The system according to claim 1, wherein the master device is also in communication with a database server.

4. The system according to claim 3, wherein a gas leak event is saved to said database server.

5. The system according to claim 1, wherein the room temperature value is between −10° C. to 40° C.

6. The system according to claim 1, wherein the calculated difference is between 10° C. to 20° C.

7. The system according to claim 1, wherein the temperature setpoint is between 150° C. to 250° C.

8. The system according to claim 1, wherein the delay time of step vi) is 10 seconds.

9. An oven cover comprising a plurality of burners and a plurality of knobs, characterized in that each of an axis (1) of each knob is coupled to the system of claim 1, by means of the pinion (2) coupled to axis knob, and where the system is hidden in a lower part of the cover.

10. The system according to claim 1, wherein said pinion (3) coupled to the motor has teeth in only a portion of its perimeter, while the rest of its perimeter is circumferential.

11. The system according to claim 1, wherein said pinion (3) coupled to the motor has teeth in 30% of its perimeter, while the remaining 70% of its perimeter is circumferential.

12. The system according to claim 1, wherein said master device sends an alert to said user interface when a gas leak is identified.

13. The system according to claim 1, wherein a user verifies via said user interface at least one of: whether said knob is turned on or turned off or an existence of a gas leak.

14. The system according to claim 1, wherein a user remotely controls turning off said knob via said user interface.

15. The system according to claim 14, wherein said knob is remotely turned off immediately or with a time delay.

* * * * *